US008783034B2

(12) United States Patent
Held

(10) Patent No.: US 8,783,034 B2
(45) Date of Patent: Jul. 22, 2014

(54) HOT DAY CYCLE

(75) Inventor: Timothy James Held, Akron, OH (US)

(73) Assignee: Echogen Power Systems, LLC, Akron, OH (US)

( * ) Notice: Subject to any disclaimer, the term of this patent is extended or adjusted under 35 U.S.C. 154(b) by 387 days.

(21) Appl. No.: 13/290,735

(22) Filed: Nov. 7, 2011

(65) Prior Publication Data

US 2013/0113221 A1 May 9, 2013

(51) Int. Cl.
*F01K 25/08* (2006.01)
*F01K 9/02* (2006.01)

(52) U.S. Cl.
USPC ..... 60/651; 60/671; 60/692; 60/693

(58) Field of Classification Search
USPC ..... 60/651, 671, 692, 693, 694
See application file for complete search history.

(56) References Cited

U.S. PATENT DOCUMENTS

| | | | |
|---|---|---|---|
| 2,575,478 | A | 11/1951 | Wilson |
| 2,634,375 | A | 4/1953 | Guimbal |
| 2,691,280 | A | 10/1954 | Albert |
| 3,095,274 | A | 6/1963 | Crawford |
| 3,105,748 | A | 10/1963 | Stahl |
| 3,237,403 | A | 3/1966 | Feher |
| 3,277,955 | A | 10/1966 | Heller |
| 3,401,277 | A | 9/1968 | Larson |
| 3,622,767 | A | 11/1971 | Koepcke |
| 3,736,745 | A | 6/1973 | Karig |
| 3,772,879 | A | 11/1973 | Engdahl |
| 3,791,137 | A | 2/1974 | Jubb |
| 3,939,328 | A | 2/1976 | Davis |
| 3,971,211 | A | 7/1976 | Wethe |
| 3,982,379 | A | 9/1976 | Gilli |
| 3,998,058 | A | 12/1976 | Park |
| 4,009,575 | A | 3/1977 | Hartman, Jr. |
| 4,029,255 | A | 6/1977 | Heiser |
| 4,030,312 | A | 6/1977 | Wallin |
| 4,049,407 | A | 9/1977 | Bottum |
| 4,070,870 | A | 1/1978 | Bahel |
| 4,099,381 | A | 7/1978 | Rappoport |
| 4,119,140 | A | 10/1978 | Cates |
| 4,152,901 | A | 5/1979 | Munters |

(Continued)

FOREIGN PATENT DOCUMENTS

| | | | |
|---|---|---|---|
| CA | 2794150 | A1 | 11/2011 |
| CN | 202055876 | U | 11/2011 |

(Continued)

OTHER PUBLICATIONS

PCT/US2011/029486—International Search Report and Written Opinion dated Nov. 16, 2011.

(Continued)

*Primary Examiner* — Hoang Nguyen
(74) *Attorney, Agent, or Firm* — Edmonds & Nolte, PC

(57) ABSTRACT

A thermodynamic cycle is disclosed and has a working fluid circuit that converts thermal energy into mechanical energy on hot days. A pump circulates a working fluid to a heat exchanger that heats the working fluid. The heated working fluid is then expanded in a power turbine. The expanded working fluid is then cooled and condensed using one or more compressors interposing at least two intercooling components. The intercooling components cool and condense the working fluid with a cooling medium derived at ambient temperature, where the ambient temperature is above the critical temperature of the working fluid.

20 Claims, 5 Drawing Sheets

(56) References Cited

U.S. PATENT DOCUMENTS 4,164,848 A 8/1979 Gilli
4,164,849 A 8/1979 Mangus
4,182,960 A 1/1980 Reuyl
4,183,220 A 1/1980 Shaw
4,198,827 A 4/1980 Terry et al.
4,208,882 A 6/1980 Lopes
4,221,185 A 9/1980 Scholes
4,233,085 A 11/1980 Roderick
4,248,049 A 2/1981 Briley
4,257,232 A 3/1981 Bell
4,287,430 A 9/1981 Guido
4,336,692 A 6/1982 Ecker
4,347,711 A 9/1982 Noe
4,347,714 A 9/1982 Kinsell
4,372,125 A 2/1983 Dickenson
4,384,568 A 5/1983 Palmatier
4,391,101 A 7/1983 Labbe
4,420,947 A 12/1983 Yoshino
4,428,190 A 1/1984 Bronicki
4,433,554 A 2/1984 Rojey
4,439,687 A 3/1984 Wood
4,439,994 A 4/1984 Briley
4,448,033 A 5/1984 Briccetti
4,450,363 A 5/1984 Russell
4,455,836 A 6/1984 Binstock
4,467,609 A 8/1984 Loomis
4,467,621 A 8/1984 O'Brien
4,475,353 A 10/1984 Lazare
4,489,562 A 12/1984 Snyder
4,489,563 A 12/1984 Kalina
4,498,289 A 2/1985 Osgerby
4,516,403 A 5/1985 Tanaka
4,549,401 A 10/1985 Spliethoff
4,555,905 A 12/1985 Endou
4,558,228 A 12/1985 Larjola
4,573,321 A 3/1986 Knaebel
4,578,953 A 4/1986 Krieger
4,589,255 A 5/1986 Martens
4,636,578 A 1/1987 Feinberg
4,674,297 A 6/1987 Vobach
4,694,189 A 9/1987 Haraguchi
4,700,543 A 10/1987 Krieger
4,756,162 A 7/1988 Dayan
4,765,143 A 8/1988 Crawford
4,773,212 A 9/1988 Griffin
4,798,056 A 1/1989 Franklin
4,813,242 A 3/1989 Wicks
4,821,514 A 4/1989 Schmidt
4,986,071 A 1/1991 Voss
4,993,483 A 2/1991 Harris
5,000,003 A 3/1991 Wicks
5,050,375 A 9/1991 Dickinson
5,098,194 A 3/1992 Kuo
5,164,020 A 11/1992 Wagner
5,176,321 A 1/1993 Doherty
5,203,159 A 4/1993 Koizumi et al.
5,228,310 A 7/1993 Vandenberg
5,291,960 A 3/1994 Brandenburg
5,335,510 A 8/1994 Rockenfeller
5,360,057 A 11/1994 Rockenfeller
5,392,606 A 2/1995 Labinov
5,440,882 A 8/1995 Kalina
5,444,972 A 8/1995 Moore
5,488,828 A 2/1996 Brossard
5,490,386 A 2/1996 Keller
5,503,222 A 4/1996 Dunne
5,531,073 A 7/1996 Bronicki
5,538,564 A 7/1996 Kaschmitter
5,542,203 A 8/1996 Luoma
5,544,479 A * 8/1996 Yan et al. ..... 60/39.183
5,570,578 A 11/1996 Saujet
5,588,298 A 12/1996 Kalina
5,600,967 A 2/1997 Meckler
5,647,221 A 7/1997 Garris, Jr.
5,649,426 A 7/1997 Kalina
5,676,382 A 10/1997 Dahlheimer
5,680,753 A 10/1997 Hollinger
5,738,164 A 4/1998 Hildebrand
5,754,613 A 5/1998 Hashiguchi
5,771,700 A 6/1998 Cochran
5,789,822 A 8/1998 Calistrat
5,799,490 A * 9/1998 Bronicki et al. ..... 60/655
5,813,215 A 9/1998 Weisser
5,833,876 A 11/1998 Schnur
5,873,260 A 2/1999 Linhardt
5,874,039 A 2/1999 Edelson
5,894,836 A 4/1999 Wu
5,899,067 A 5/1999 Hageman
5,903,060 A 5/1999 Norton
5,918,460 A 7/1999 Connell
5,941,238 A 8/1999 Tracy
5,943,869 A 8/1999 Cheng
5,946,931 A 9/1999 Lomax
5,973,050 A 10/1999 Johnson
6,037,683 A 3/2000 Lulay et al.
6,041,604 A 3/2000 Nicodemus
6,058,930 A 5/2000 Shingleton
6,062,815 A 5/2000 Holt
6,065,280 A 5/2000 Ranasinghe
6,066,797 A 5/2000 Toyomura
6,070,405 A 6/2000 Jerye
6,082,110 A 7/2000 Rosenblatt
6,105,368 A 8/2000 Hansen
6,112,547 A 9/2000 Spauschus
6,158,237 A 12/2000 Riffat
6,164,655 A 12/2000 Bothien
6,202,782 B1 3/2001 Hatanaka
6,223,846 B1 5/2001 Schechter
6,233,938 B1 5/2001 Nicodemus
6,282,900 B1 9/2001 Bell
6,282,917 B1 9/2001 Mongan
6,295,818 B1 10/2001 Ansley
6,299,690 B1 10/2001 Mongeon
6,341,781 B1 1/2002 Matz
6,374,630 B1 4/2002 Jones
6,393,851 B1 5/2002 Wightman
6,432,320 B1 8/2002 Bonsignore
6,434,955 B1 8/2002 Ng
6,442,951 B1 9/2002 Maeda
6,446,425 B1 9/2002 Lawlor
6,446,465 B1 9/2002 Dubar
6,463,730 B1 10/2002 Keller
6,484,490 B1 11/2002 Olsen
6,539,720 B2 4/2003 Rouse et al.
6,539,728 B2 4/2003 Korin
6,571,548 B1 6/2003 Bronicki
6,598,397 B2 7/2003 Hanna
6,644,062 B1 11/2003 Hays
6,657,849 B1 12/2003 Andresakis
6,668,554 B1 12/2003 Brown
6,684,625 B2 2/2004 Kline
6,695,974 B2 2/2004 Withers
6,715,294 B2 4/2004 Anderson
6,734,585 B2 5/2004 Tornquist
6,735,948 B1 5/2004 Kalina
6,739,142 B2 5/2004 Korin
6,751,959 B1 6/2004 McClanahan
6,769,256 B1 8/2004 Kalina
6,799,892 B2 10/2004 Leuthold
6,808,179 B1 10/2004 Bhattacharyya
6,810,335 B2 10/2004 Lysaght
6,817,185 B2 11/2004 Coney
6,857,268 B2 2/2005 Stinger
6,910,334 B2 6/2005 Kalina
6,918,254 B2 7/2005 Baker
6,921,518 B2 7/2005 Johnston
6,941,757 B2 9/2005 Kalina
6,960,839 B2 11/2005 Zimron
6,960,840 B2 11/2005 Willis
6,962,054 B1 11/2005 Linney
6,964,168 B1 11/2005 Pierson
6,968,690 B2 11/2005 Kalina
6,986,251 B2 1/2006 Radcliff
7,013,205 B1 3/2006 Hafner et al.

(56) References Cited

U.S. PATENT DOCUMENTS 7,021,060 B1 4/2006 Kalina
7,022,294 B2 4/2006 Johnston
7,033,533 B2 4/2006 Lewis-Aburn et al.
7,036,315 B2 5/2006 Kang
7,041,272 B2 5/2006 Keefer
7,047,744 B1 5/2006 Robertson
7,048,782 B1 5/2006 Couch
7,062,913 B2 6/2006 Christensen
7,096,665 B2 8/2006 Stinger
7,124,587 B1 10/2006 Linney
7,174,715 B2 2/2007 Armitage
7,194,863 B2 3/2007 Ganev
7,197,876 B1 4/2007 Kalina
7,200,996 B2 4/2007 Cogswell
7,234,314 B1 6/2007 Wiggs
7,249,588 B2 7/2007 Russell
7,278,267 B2 10/2007 Yamada
7,279,800 B2 10/2007 Bassett
7,287,381 B1 10/2007 Pierson
7,305,829 B2 12/2007 Mirolli
7,313,926 B2 1/2008 Gurin
7,340,894 B2 3/2008 Miyahara et al.
7,340,897 B2 3/2008 Zimron
7,406,830 B2 8/2008 Valentian
7,416,137 B2 8/2008 Hagen et al.
7,453,242 B2 11/2008 Ichinose
7,458,217 B2 12/2008 Kalina
7,458,218 B2 12/2008 Kalina
7,469,542 B2 12/2008 Kalina
7,516,619 B2 4/2009 Pelletier
7,621,133 B2 11/2009 Tomlinson
7,654,354 B1 2/2010 Otterstrom
7,665,291 B2 2/2010 Anand
7,665,304 B2 2/2010 Sundel
7,685,821 B2 3/2010 Kalina
7,730,713 B2 6/2010 Nakano
7,735,335 B2 6/2010 Uno
7,770,376 B1 8/2010 Brostmeyer
7,827,791 B2 11/2010 Pierson
7,838,470 B2 11/2010 Shaw
7,841,179 B2 11/2010 Kalina
7,841,306 B2 11/2010 Myers
7,854,587 B2 12/2010 Ito
7,866,157 B2 1/2011 Ernst
7,900,450 B2 3/2011 Gurin
7,950,230 B2 5/2011 Nishikawa
7,950,243 B2 5/2011 Gurin
7,972,529 B2 7/2011 Machado
8,096,128 B2 1/2012 Held et al.
8,099,198 B2 1/2012 Gurin
8,146,360 B2 4/2012 Myers
8,281,593 B2 10/2012 Held
2001/0015061 A1 8/2001 Viteri et al.
2001/0030952 A1 10/2001 Roy
2002/0029558 A1 3/2002 Tamaro
2002/0066270 A1 6/2002 Rouse et al.
2002/0078696 A1 6/2002 Korin
2002/0078697 A1 6/2002 Lifson
2002/0082747 A1 6/2002 Kramer
2003/0000213 A1 1/2003 Christensen
2003/0061823 A1 4/2003 Alden
2003/0154718 A1 8/2003 Nayar
2003/0182946 A1 10/2003 Sami
2003/0213246 A1 11/2003 Coll et al.
2003/0221438 A1 12/2003 Rane et al.
2004/0011038 A1 1/2004 Stinger
2004/0011039 A1 1/2004 Stinger et al.
2004/0020185 A1 2/2004 Brouillette et al.
2004/0020206 A1 2/2004 Sullivan et al.
2004/0021182 A1 2/2004 Green et al.
2004/0035117 A1 2/2004 Rosen
2004/0083731 A1 5/2004 Lasker
2004/0083732 A1 5/2004 Hanna et al.
2004/0097388 A1 5/2004 Brask et al.
2004/0105980 A1 6/2004 Sudarshan et al.
2004/0107700 A1 6/2004 McClanahan et al.
2004/0159110 A1 8/2004 Janssen
2004/0211182 A1 10/2004 Gould
2005/0056001 A1 3/2005 Frutschi
2005/0096676 A1 5/2005 Gifford, III et al.
2005/0109387 A1 5/2005 Marshall
2005/0137777 A1 6/2005 Kolavennu et al.
2005/0162018 A1 7/2005 Realmuto et al.
2005/0167169 A1 8/2005 Gering et al.
2005/0183421 A1 8/2005 Vaynberg et al.
2005/0196676 A1 9/2005 Singh et al.
2005/0198959 A1 9/2005 Schubert
2005/0227187 A1 10/2005 Schilling
2005/0252235 A1 11/2005 Critoph et al.
2005/0257812 A1 11/2005 Wright et al.
2006/0010868 A1 1/2006 Smith
2006/0060333 A1 3/2006 Chordia et al.
2006/0066113 A1 3/2006 Ebrahim et al.
2006/0080960 A1 4/2006 Rajendran et al.
2006/0112693 A1 6/2006 Sundel
2006/0182680 A1 8/2006 Keefer et al.
2006/0211871 A1 9/2006 Dai et al.
2006/0213218 A1 9/2006 Uno et al.
2006/0225459 A1 10/2006 Meyer
2006/0249020 A1 11/2006 Tonkovich et al.
2006/0254281 A1 11/2006 Badeer et al.
2007/0001766 A1 1/2007 Ripley et al.
2007/0019708 A1 1/2007 Shiflett et al.
2007/0027038 A1 2/2007 Kamimura et al.
2007/0056290 A1 3/2007 Dahm
2007/0089449 A1 4/2007 Gurin
2007/0108200 A1 5/2007 McKinzie, II
2007/0119175 A1 5/2007 Ruggieri et al.
2007/0130952 A1 6/2007 Copen
2007/0151244 A1 7/2007 Gurin
2007/0161095 A1 7/2007 Gurin
2007/0163261 A1 7/2007 Strathman
2007/0195152 A1 8/2007 Kawai et al.
2007/0204620 A1 9/2007 Pronske et al.
2007/0227472 A1 10/2007 Takeuchi et al.
2007/0234722 A1 10/2007 Kalina
2007/0245733 A1 10/2007 Pierson et al.
2007/0246206 A1 10/2007 Gong et al.
2008/0006040 A1 1/2008 Peterson et al.
2008/0010967 A1 1/2008 Griffin
2008/0023666 A1 1/2008 Gurin
2008/0053095 A1 3/2008 Kalina
2008/0066470 A1 3/2008 MacKnight
2008/0135253 A1 6/2008 Vinegar et al.
2008/0173450 A1 7/2008 Goldberg et al.
2008/0211230 A1 9/2008 Gurin
2008/0250789 A1 10/2008 Myers et al.
2008/0252078 A1 10/2008 Myers
2009/0021251 A1 1/2009 Simon
2009/0085709 A1 4/2009 Meinke
2009/0107144 A1 4/2009 Moghtaderi et al.
2009/0139234 A1 6/2009 Gurin
2009/0139781 A1 6/2009 Straubel
2009/0173337 A1 7/2009 Tamaura et al.
2009/0173486 A1 7/2009 Copeland et al.
2009/0180903 A1 7/2009 Martin et al.
2009/0205892 A1 8/2009 Jensen et al.
2009/0211251 A1 8/2009 Petersen et al.
2009/0257902 A1* 10/2009 Ernens ..... 418/201.1
2009/0266075 A1 10/2009 Westmeier et al.
2009/0293503 A1 12/2009 Vandor
2010/0024421 A1 2/2010 Litwin
2010/0077792 A1 4/2010 Gurin
2010/0083662 A1 4/2010 Kalina
2010/0122533 A1 5/2010 Kalina
2010/0146949 A1 6/2010 Stobart et al.
2010/0146973 A1 6/2010 Kalina
2010/0156112 A1 6/2010 Held et al.
2010/0162721 A1 7/2010 Welch et al.
2010/0205962 A1 8/2010 Kalina
2010/0218513 A1 9/2010 Vaisman et al.
2010/0218930 A1 9/2010 Proeschel
2010/0263380 A1 10/2010 Biederman et al.
2010/0300093 A1 12/2010 Doty

(56) References Cited

U.S. PATENT DOCUMENTS

| | | | | |
|---|---|---|---|---|
| 2010/0319346 | A1* | 12/2010 | Ast et al. | 60/616 |
| 2010/0326076 | A1 | 12/2010 | Ast et al. | |
| 2011/0030404 | A1 | 2/2011 | Gurin | |
| 2011/0048012 | A1 | 3/2011 | Ernst et al. | |
| 2011/0061384 | A1 | 3/2011 | Held et al. | |
| 2011/0061387 | A1 | 3/2011 | Held et al. | |
| 2011/0088399 | A1 | 4/2011 | Briesch et al. | |
| 2011/0113781 | A1* | 5/2011 | Frey et al. | 60/659 |
| 2011/0179799 | A1 | 7/2011 | Allam | |
| 2011/0185729 | A1 | 8/2011 | Held | |
| 2011/0192163 | A1 | 8/2011 | Kasuya | |
| 2012/0047892 | A1 | 3/2012 | Held et al. | |
| 2012/0067055 | A1 | 3/2012 | Held | |
| 2012/0128463 | A1 | 5/2012 | Held | |
| 2012/0131918 | A1 | 5/2012 | Held | |
| 2012/0131919 | A1 | 5/2012 | Held | |
| 2012/0131920 | A1 | 5/2012 | Held | |
| 2012/0131921 | A1 | 5/2012 | Held | |
| 2012/0159922 | A1 | 6/2012 | Gurin | |
| 2012/0159956 | A1 | 6/2012 | Gurin | |
| 2012/0174558 | A1 | 7/2012 | Gurin | |
| 2012/0186219 | A1 | 7/2012 | Gurin | |
| 2012/0247134 | A1 | 10/2012 | Gurin | |
| 2012/0247455 | A1 | 10/2012 | Gurin et al. | |
| 2013/0033037 | A1 | 2/2013 | Held et al. | |
| 2013/0036736 | A1 | 2/2013 | Hart et al. | |
| 2013/0113221 | A1 | 5/2013 | Held | |

FOREIGN PATENT DOCUMENTS

| | | | |
|---|---|---|---|
| CN | 202544943 | U | 11/2012 |
| CN | 202718721 | U | 2/2013 |
| DE | 19906087 | A1 | 8/2000 |
| DE | 10052993 | A1 | 5/2002 |
| EP | 1977174 | A2 | 10/2008 |
| EP | 2419621 | A1 | 2/2012 |
| EP | 2446122 | A1 | 5/2012 |
| EP | 2478201 | A1 | 7/2012 |
| EP | 2500530 | A1 | 7/2012 |
| EP | 2550436 | A1 | 9/2012 |
| GB | 856985 | A | 12/1960 |
| GB | 2075608 | A | 11/1981 |
| JP | 58-193051 | A | 11/1983 |
| JP | 61-152914 | A | 7/1986 |
| JP | 01-240705 | A | 9/1989 |
| JP | 05-321612 | A | 12/1993 |
| JP | 06-331225 | A | 11/1994 |
| JP | 09-100702 | A | 4/1997 |
| JP | 2641581 | B2 | 5/1997 |
| JP | 09-209716 | A | 8/1997 |
| JP | 2858750 | B2 | 12/1998 |
| JP | 2001-193419 | A | 7/2001 |
| JP | 2002-097965 | A | 4/2002 |
| JP | 2004-239250 | A | 8/2004 |
| JP | 2004-332626 | A | 11/2004 |
| JP | 2005-533972 | | 11/2005 |
| JP | 2005-533972 | A1 | 11/2005 |
| JP | 2007-198200 | | 8/2007 |
| JP | 2007-198200 | A | 9/2007 |
| JP | 4343738 | B2 | 10/2009 |
| JP | 2011-017268 | A | 1/2011 |
| KR | 10-0191080 | B1 | 6/1999 |
| KR | 100191080 | | 6/1999 |
| KR | 10-2007-0086244 | A | 8/2007 |
| KR | 10-0766101 | B1 | 10/2007 |
| KR | 10-0844634 | A | 7/2008 |
| KR | 10-0844634 | B1 | 7/2008 |
| KR | 10-20100067927 | A | 6/2010 |
| KR | 1020110018769 | A | 2/2011 |
| KR | 1069914 | B1 | 9/2011 |
| KR | 1103549 | B1 | 1/2012 |
| KR | 10-2012-0058582 | A | 6/2012 |
| KR | 2012-0068670 | A | 6/2012 |
| KR | 2012-0128753 | A | 11/2012 |
| KR | 2012-0128755 | A | 11/2012 |
| WO | WO 91/05145 | A1 | 4/1991 |
| WO | WO 96/09500 | A1 | 3/1996 |
| WO | WO 01/44658 | A1 | 6/2001 |
| WO | WO 2006/060253 | | 6/2006 |
| WO | WO 2006/137957 | A1 | 12/2006 |
| WO | WO 2007/056241 | A2 | 5/2007 |
| WO | WO 2007/079245 | A2 | 7/2007 |
| WO | WO 2007/082103 | A2 | 7/2007 |
| WO | WO 2007/112090 | A2 | 10/2007 |
| WO | WO 2008/039725 | A2 | 4/2008 |
| WO | 2009-045196 | A1 | 4/2009 |
| WO | WO 2009/058992 | A2 | 5/2009 |
| WO | 2010-074173 | A1 | 7/2010 |
| WO | WO 2010/121255 | A1 | 10/2010 |
| WO | WO 2010/126980 | A2 | 11/2010 |
| WO | WO 2010/151560 | A1 | 12/2010 |
| WO | WO 2011/017450 | A2 | 2/2011 |
| WO | WO 2011/017476 | A1 | 2/2011 |
| WO | WO 2011/017599 | A1 | 2/2011 |
| WO | WO 2011/034984 | A1 | 3/2011 |
| WO | WO 2011/094294 | A2 | 8/2011 |
| WO | WO 2011/119650 | A2 | 9/2011 |
| WO | 2012-074905 | A2 | 6/2012 |
| WO | 2012-074907 | A2 | 6/2012 |
| WO | 2012-074911 | A2 | 6/2012 |
| WO | WO 2012/074940 | A2 | 6/2012 |
| WO | WO 2013/055691 | A1 | 4/2013 |
| WO | WO 2013/059687 | A1 | 4/2013 |
| WO | WO 2013/059695 | A1 | 4/2013 |
| WO | WO 2013/070249 | A1 | 5/2013 |
| WO | WO 2013/074907 | A1 | 5/2013 |

OTHER PUBLICATIONS

PCT/US2011/062201—International Search Report and Written Opinion dated Jun. 26, 2012.

PCT/US2011/062207—International Search Report and Written Opinion dated Jun. 28, 2012.

PCT/US2011/062198—International Search Report and Written Opinion dated Jul. 2, 2012.

PCT/US2011/062266—International Search Report and Written Opinion dated Jul. 9, 2012.

PCT/US2011/029486—International Preliminary Report on Patentability dated Sep. 25, 2012.

PCT/US2012/062204—International Search Report and Written Opinion dated Nov. 1, 2012.

Vaclav Dostal, Martin Kulhanek, "Research on the Supercritical Carbon Dioxide Cycles in the Czech Republic", Department of Fluid Mechanics and Power Engineering Czech Technical University in Prague, RPI, Troy, NY, Apr. 29-30, 2009; 8 pages.

Alpy, N., et al., "French Atomic Energy Commission views as regards SCO2 Cycle Development priorities and related R&D approach," Presentation, Symposium on SCO2 Power Cycles, Apr. 29-30, 2009, Troy, NY, 20 pages.

Angelino, G., and Invernizzi, C.M., "Carbon Dioxide Power Cycles using Liquid Natural Gas as Heat Sink", Applied Thermal Engineering Mar. 3, 2009, 43 pages.

Bryant, John C., Saari, Henry, and Zanganeh, Kourosh, "An Analysis and Comparison of the Simple and Recompression Supercritical CO2 Cycles" Supercritical CO2 Power Cycle Symposium, May 24-25, 2011, Boulder, CO, 8 pages.

Chapman, Daniel J., Arias, Diego A., "An Assessment of the Supercritical Carbon Dioxide Cycle for Use in a Solar Parabolic Trough Power Plant", Presentation, Abengoa Solar, Apr. 29-30, 2009, Troy, NY, 20 pages.

Chapman, Daniel J., Arias, Diego A., "An Assessment of the Supercritical Carbon Dioxide Cycle for Use in a Solar Parabolic Trough Power Plant", Paper, Abengoa Solar, Apr. 29-30, 2009, Troy, NY, 5 pages.

Chen, Yang, Lund Qvist, P., Johansson, A., Platell, P., "A Comparative Study of the Carbon Dioxide Transcritical Power Cycle Compared with an Organic Rankine Cycle with R123 as Working Fluid in Waste Heat Recovery", Science Direct, Applied Thermal Engineering, Jun. 12, 2006, 6 pages.

(56) References Cited

OTHER PUBLICATIONS

Chen, Yang, "Thermodynamic Cycles Using Carbon Dioxide as Working Fluid", Doctoral Thesis, School of Industrial Engineering and Management, Stockholm, Oct. 2011, 150 pages., (3 parts).
Chordia, Lalit, "Optimizing Equipment for Supercritical Applications", Thar Energy LLC, Supercritical CO2 Power Cycle Symposium, May 24-25, 2011, Boulder, CO 7 pages.
Combs, Osie V., "An Investigation of the Supercritical CO2 Cycle (Feher cycle) for Shipboard Application", Massachusetts Institute of Technology, May 1977, 290 pages.
Di Bella, Francis A., "Gas Turbine Engine Exhaust Waste Heat Recovery Navy Shipboard Module Development", Supercritical CO2 Power Cycle Symposium, May 24-25, 2011, Boulder, CO, 8 pages.
Dostal, V., et al., A Supercritical Carbon Dioxide Cycle for Next Generation Nuclear Reactors, Mar. 10, 2004, 326 pages., (7 parts).
Dostal, Vaclav, and Dostal, Jan, "Supercritical CO2 Regeneration Bypass Cycle—Comparison to Traditional Layouts", Supercritical CO2 Power Cycle Symposium, May 24-25, 2011, Boulder, CO, 5 pages.
Eisemann, Kevin, and Fuller, Robert L., "Supercritical CO2 Brayton Cycle Design and System Start-up Options", Barber Nichols, Inc., Paper, Supercritical CO2 Power Cycle Symposium, May 24-25, 2011, Boulder, CO, 7 pages.
Eisemann, Kevin, and Fuller, Robert L., "Supercritical CO2 Brayton Cycle Design and System Start-up Options", Presentation, Supercritical CO2 Power Cycle Symposium, May 24-25, 2011, Boulder, CO, 11 pages.
Feher, E.G., et al., "Investigation of Supercritical (Feher) Cycle", Astropower Laboratory, Missile & Space Systems Division, Oct. 1968, 152 pages.
Fuller, Robert L., and Eisemann, Kevin, "Centrifugal Compressor Off-Design Performance for Super-Critical CO2" , Barber Nichols, Inc. Presentation, Supercritical CO2 Power Cycle Symposium, May 24-25, 2011, Boulder, CO, 20 pages.
Fuller, Robert L., and Eisemann, Kevin, "Centrifugal Compressor Off-Design Performance for Super-Critical CO2", Paper, Supercritical CO2 Power Cycle Symposium, May 24-25, 2011, Boulder, CO, 12 pages.
Gokhstein, D.P. and Verkhivker, G.P. "Use of Carbon Dioxide as a Heat Carrier and Working Substance in Atomic Power Stations", Soviet Atomic Energy, Apr. 1969, vol. 26, Issue 4, pp. 430-432.
Gokhstein, D.P.; Taubman, E.I.; Konyaeva, G.P., "Thermodynamic Cycles of Carbon Dioxide Plant with an Additional Turbine After the Regenerator", Energy Citations Database, Mar. 1973, 1 Page, Abstract only.
Hejzlar, P. et al., "Assessment of Gas Cooled Gas Reactor with Indirect Supercritical CO2 Cycle" Massachusetts Institute of Technology, Jan. 2006, 10 pages.
Hoffman, John R., and Feher, E.G., "150 kwe Supercritical Closed Cycle System", Transactions of the ASME, Jan. 1971, pp. 70-80.
Jeong, Woo Seok, et al., "Performance of S-C02 Brayton Cycle with Additive Gases for SFR Application", Korea Advanced Institute of Science and Technology, Supercritical CO2 Power Cycle Symposium, May 24-25, 2011, Boulder, CO, 5 pages.
Johnson, Gregory A., & Mcdowell, Michael, "Issues Associated with Coupling Supercritical CO2 Power Cycles to Nuclear, Solar and Fossil Fuel Heat Sources", Hamilton Sundstrand, Energy Space & Defense-Rocketdyne, Apr. 29-30, 2009, Troy, NY, Presentation, 18 pages.
Kawakubo, Tomoki, "Unsteady Roto-Stator Interaction of a Radial-Inflow Turbine with Variable Nozzle Vanes", ASME Turbo Expo 2010: Power for Land, Sea, and Air; vol. 7: Turbomachinery, Parts A, B, and C; Glasgow, UK, Jun. 14-18, 2010, Paper No. GT2010-23677, pp. 2075-2084, (1 page, Abstract only).
Kulhanek, Martin, "Thermodynamic Analysis and Comparison of S-C02 Cycles", Presentation, Czech Technical University in Prague, Supercritical CO2 Power Cycle Symposium, May 24-25, 2011, Boulder, CO, 14 pages.
Kulhanek, Martin, "Thermodynamic Analysis and Comparison of S-C02 Cycles", Paper, Czech Technical University in Prague, Supercritical CO2 Power Cycle Symposium, May 24-25, 2011, Boulder, CO, 7 pages.
Kulhanek, Martin., and Dostal, Vaclav, "Supercritical Carbon Dioxide Cycles Thermodynamic Analysis and Comparison", Abstract, Faculty Conference held in Prague, Mar. 24, 2009, 13 pages.
Ma, Zhiwen and Turchi, Craig S., "Advanced Supercritical Carbon Dioxide Power Cycle Configurations for Use in Concentrating Solar Power Systems", National Renewable Energy Laboratory, Supercritical CO2 Power Cycle Symposium, May 24-25, 2011, Boulder, CO, 4 pages.
Munoz De Escalona, Jose M., "The Potential of the Supercritical Carbon Dioxide Cycle in High Temperature Fuel Cell Hybrid Systems", Paper, Thermal Power Group, University of Seville, Supercritical CO2 Power Cycle Symposium, May 24-25, 2011, Boulder, Co, 6 pp.
Moisseytsev, Anton, and Sienicki, Jim, "Investigation of Alternative Layouts for the Supercritical Carbon Dioxide Brayton Cycle for a Sodium-Cooled Fast Reactor", Supercritical CO2 Power Cycle Symposium, Troy, NY, Apr. 29, 2009, 26 pages.
Munoz De Escalona, Jose M., et al., "The Potential of the Supercritical Carbon Dioxide Cycle in High Temperature Fuel Cell Hybrid Systems", Presentation, Thermal Power Group, University of Seville, Supercritical CO2 Power Cycle Symposium, May 24-25, 2011, Boulder, CO, 19 pages.
Muto, Y., et al., "Application of Supercritical CO2 Gas Turbine for the Fossil Fired Thermal Plant", Journal of Energy and Power Engineering, Sep. 30, 2010, vol. 4, No. 9, 9 pages.
Muto, Yasushi, and Kato, Yasuyoshi, "Optimal Cycle Scheme of Direct Cycle Supercritical CO2 Gas Turbine for Nuclear Power Generation Systems", International Conference on Power Engineering-2007, Oct. 23-27, 2007, Hangzhou, China, pp. 86-87.
Noriega, Bahamonde J.S., "Design Method for s-C02 Gas Turbine Power Plants", Master of Science Thesis, Delft University of Technology, Oct. 2012, 122 pages., (3 parts).
Oh, Chang, et al., "Development of a Supercritical Carbon Dioxide Brayton Cycle: Improving PBR Efficiency and Testing Material Compatibility", Presentation, Nuclear Energy Research Initiative Report, Oct. 2004, 38 pages.
Oh, Chang; et al., "Development of a Supercritical Carbon Dioxide Brayton Cycle: Improving VHTR Efficiency and Testing Material Compatibility", Presentation, Nuclear Energy Research Initiative Report, Final Report, Mar. 2006, 97 pages.
Parma, Ed, et al., "Supercritical CO2 Direct Cycle Gas Fast Reactor (SC-GFR) Concept" Presentation for Supercritical CO2 Power Cycle Symposium, May 24-25, 2011, Boulder, CO, 40 pages.
Parma, Ed, et al., "Supercritical CO2 Direct Cycle Gas Fast Reactor (SC-GFR) Concept", Supercritical CO2 Power Cycle Symposium, May 24-25, 2011, Boulder, CO, 9 pages.
Parma, Edward J., et al., "Supercritical CO2 Direct Cycle Gas Fast Reactor (SC-GFR) Concept", Presentation, Sandia National Laboratories, May 2011, 55 pages.
PCT/US2006/049623 (EPS-020PCT)—Written Opinion of ISA dated Jan. 4, 2008, 4 pages.
PCT/US2007/001120 (EPS-019PCT)—International Search Report dated Apr. 25, 2008, 7 pages.
PCT/US2007/079318 (EPS-021PCT)—International Preliminary Report on Patentability dated Jul. 7, 2008, 5 pages.
PCT/US2010/031614 (EPS-014)—International Search Report dated Jul. 12, 2010, 3 pages.
PCT/US2010/031614—(EPS-14)—International Preliminary Report on Patentability dated Oct. 27, 2011, 9 pages.
PCT/US2010/039559 (EPS-015)—International Preliminary Report on Patentability dated Jan. 12, 2012, 7 pages.
PCT/US2010/039559 (EPS-015)—Notification of Transmittal of the International Search Report and Written Opinion of the International Searching Authority, or the Declaration dated Sep. 1, 2010, 6 pages.
PCT/US2010/044476(EPS-018)—International Search Report dated Sep. 29, 2010, 23 pages.
PCT/US2010/044681 (EPS016)—International Search Report and Written Opinion mailed Oct. 7,2010,10 pages.

(56) References Cited

OTHER PUBLICATIONS

PCT/US2010/044681 (EPS-016)—International Preliminary Report on Patentability dated Feb. 16, 2012, 9 pages.
PCT/US2010/049042 (EPS-008)—International Search Report and Written Opinion dated Nov. 17, 2010, 11 pages.
PCT/US2010/049042 (EPS-008)—International Preliminary Report on Patentability dated Mar. 29, 2012, 18 pages.
PCT/US2012/000470 (EPS-124)—International Search Report dated Mar. 8, 2013, 10 pages.
PCT/US2012/061151 (EPS-125)—International Search Report and Written Opinion dated Feb. 25, 2013, 9 pages.
PCT/US2012/061159 (EPS-126)—International Search Report dated Mar. 2, 2013, 10 pages.
Persichilli, Michael, et al., "Supercritical CO2 Power Cycle Developments and Commercialization: Why sCO2 can Displace Steam" Echogen Power Systems LLC, Power-Gen India & Central Asia 2012, Apr. 19-21, 2012, New Delhi, India, 15 pages.
Saari, Henry, et al., "Supercritical CO2 Advanced Brayton Cycle Design", Presentation, Carleton University, Supercritical CO2 Power Cycle Symposium, May 24-25, 2011, Boulder, CO, 21 pages.
San Andres, Luis, "Start-Up Response of Fluid Film Lubricated Cryogenic Turbopumps (Preprint)", AIAA/ASME/SAE/ASEE Joint Propulsion Conference, Cincinnati, OH, Jul. 8-11, 2007, 38 pages.
Sarkar, J., and Bhattacharyya, Souvik, "Optimization of Recompression S-CO2 Power Cycle with Reheating" Energy Conversion and Management 50 (May 17, 2009), pp. 1939-1945.
Tom, Samsun Kwok Sun, "The Feasibility of Using Supercritical Carbon Dioxide as a Coolant for the Candu Reactor", the University of British Columbia, Jan. 1978, 156 pages.
VGB PowerTech Service GmbH, "CO2 Capture and Storage", A VGB Report on the State of the Art, Aug. 25, 2004, 112 pages.
Vidhi, Rachana, et al., "Study of Supercritical Carbon Dioxide Power Cycle for Power Conversion from Low Grade Heat Sources", Presentation, University of South Florida and Oak Ridge National Laboratory, Supercritical CO2 Power Cycle Symposium, May 24-25, 2011, Boulder, CO, 17 pages.
Vidhi, Rachana, et al.., "Study of Supercritical Carbon Dioxide Power Cycle for Power Conversion from Low Grade Heat Sources", Paper, University of South Florida and Oak Ridge National Laboratory, Supercritical CO2 Power Cycle Symposium, May 24-25, 2011, Boulder, CO, 8 pages.
Wright, Steven A., et al., "Modeling and Experimental Results for Condensing Supercritical CO2 Power Cycles", Sandia Report, Jan. 2011, 47 pages.
Wright, Steven A., et al., "Supercritical CO2 Power Cycle Development Summary at Sandia National Laboratories", May 24-25, 2011, (1 page, Abstract only).
Wright, Steven, "Mighty Mite", Mechanical Engineering, Jan. 2012, pp. 41-43.
Yoon, Ho Joon, et at, "Preliminary Results of Optimal Pressure Ratio for Supercritical CO2 Brayton Cycle coupled with Small Modular Water Cooled Reactor", Presentation, Korea Advanced Institute of Science and Technology and Khalifa University of Science, Technology and Research, Boulder, CO, May 25, 2011, 18 pages.
Yoon, Ho Joon, et al., "Preliminary Results of Optimal Pressure Ratio for Supercritical CO2 Brayton Cycle coupled with Small Modular Water Cooled Reactor", Paper, Korea Advanced Institute of Science and Technology and Khalifa University of Science, Technology and Research, May 24-25, 2011, Boulder, CO, 7 pages.

* cited by examiner

HOT DAY CYCLE

BACKGROUND

Heat is often created as a byproduct of industrial processes where flowing streams of liquids, solids, or gasses containing heat must be exhausted into the environment or otherwise removed in some way in an effort to regulate the operating temperatures of the industrial process equipment. The industrial process oftentimes uses heat exchangers to capture the heat and recycle it back into the process via other process streams. Other times it is not feasible to capture and recycle the heat because it is either too hot or it may contain insufficient mass flow. This heat is referred to as "waste" heat and is typically discharged directly into the environment or indirectly through a cooling medium, such as water or air.

Waste heat can be converted into useful work by a variety of turbine generator systems that employ well-known thermodynamic cycles, such as the Rankine cycle. These thermodynamic methods are typically steam-based processes where the waste heat is recovered and used to generate steam from water in a boiler in order to drive a corresponding turbine. Organic Rankine cycles replace the water with a lower boiling-point working fluid, such as a light hydrocarbon like propane or butane, or a HCFC (e.g., R245fa) fluid. More recently, however, and in view of issues such as thermal instability, toxicity, or flammability of the lower boiling-point working fluids, some thermodynamic cycles have been modified to circulate more greenhouse-friendly and/or neutral working fluids, such as carbon dioxide ($CO_2$) or ammonia.

The efficiency of a thermodynamic cycle is largely dependent on the pressure ratio achieved across the system expander (or turbine). As this pressure ratio increases, so does the efficiency of the cycle. One way to alter the pressure ratio is to manipulate the temperature of the working fluid in the thermodynamic cycle, especially at the suction inlet of the cycle pump (or compressor). Heat exchangers, such as condensers, are typically used for this purpose, but conventional condensers are directly limited by the temperature of the cooling medium being circulated therein, which is frequently ambient air or water.

On hot days, when the temperature of the cooling medium is heightened, condensing the working fluid with a conventional condenser can be problematic. This is especially challenging in thermodynamic cycles having a working fluid with a critical temperature that is lower than the ambient temperature. As a result, the condenser can no longer condense the working fluid, and cycle efficiency inevitably suffers.

Accordingly, there exists a need in the art for a thermodynamic cycle that can efficiently and effectively operate with a working fluid that does not condense on hot days, thereby increasing thermodynamic cycle power output derived from not only waste heat but also from a wide range of other thermal sources.

SUMMARY

Embodiments of the disclosure may provide a working fluid circuit for converting thermal energy into mechanical energy. The working fluid circuit may include a pump configured to circulate a working fluid through the working fluid circuit. A heat exchanger may be in fluid communication with the pump and in thermal communication with a heat source, and the heat exchanger may be configured to transfer thermal energy from the heat source to the working fluid. A power turbine may be fluidly coupled to the heat exchanger and configured to expand the working fluid discharged from the heat exchanger to generate the mechanical energy. Two or more intercooling components may be in fluid communication with the power turbine and configured to cool and condense the working fluid using a cooling medium derived at or near ambient temperature. One or more compressors may be fluidly coupled to the two or more intercooling components such that at least one of the one or more compressors is interposed between adjacent intercooling components.

Embodiments of the disclosure may also provide a method for regulating a pressure and a temperature of a working fluid in a working fluid circuit. The method may include circulating the working fluid through the working fluid circuit with a pump. The working fluid may be heated in a heat exchanger arranged in the working fluid circuit in fluid communication with the pump, and the heat exchanger may be in thermal communication with a heat source. The working fluid discharged from the heat exchanger may be expanded in a power turbine fluidly coupled to the heat exchanger. The working fluid discharged from the power turbine may be cooled and condensed in at least two intercooling components in fluid communication with the power turbine. The at least two intercooling components may use a cooling medium at an ambient temperature to cool the working fluid, and the ambient temperature may be above a critical temperature of the working fluid. The working fluid discharged from the two or more intercooling components may be compressed with one or more compressors fluidly coupled to the two or more intercooling components such that at least one of the one or more compressors is interposed between fluidly adjacent intercooling components.

Embodiments of the disclosure may further provide a working fluid circuit. The working fluid circuit may include a pump configured to circulate a carbon dioxide working fluid through the working fluid circuit. A waste heat exchanger may be in fluid communication with the pump and in thermal communication with a waste heat source, and the heat exchanger being configured to transfer thermal energy from the waste heat source to the carbon dioxide working fluid. A power turbine may be fluidly coupled to the heat exchanger and configured to expand the carbon dioxide working fluid discharged from the heat exchanger. A precooler may be fluidly coupled to the power turbine and configured to remove thermal energy from the carbon dioxide working fluid. A first compressor may be fluidly coupled to the precooler and configured to increase a pressure of the carbon dioxide working fluid. An intercooler may be fluidly coupled to the first compressor and configured to remove additional thermal energy from the carbon dioxide working fluid, and the first compressor may be fluidly interposing the precooler and the intercooler.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
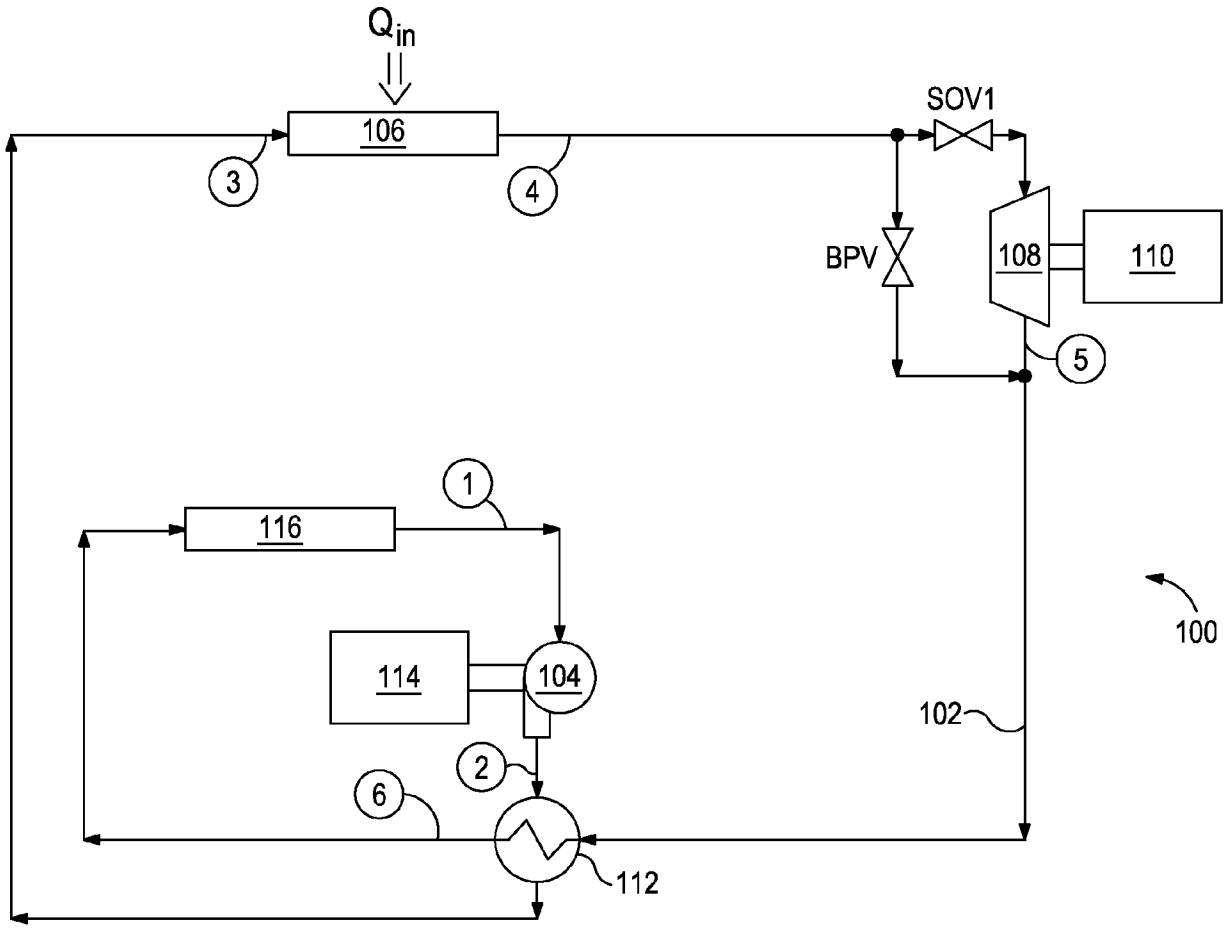
FIG. 1 illustrates an exemplary thermodynamic cycle, according to one or more embodiments of the disclosure.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a baseline recuperated "simple" thermodynamic cycle 100 that pumps a working fluid through a working fluid circuit 102 to produce power from a wide range of thermal sources. The thermodynamic cycle 100 may encompass one or more elements of a Rankine thermodynamic cycle and may operate as a closed-loop cycle, where the working fluid circuit 102 has a flow path defined by a variety of conduits adapted to interconnect the various components of the circuit 102. The circuit 102 may or may not be hermetically-sealed such that no amount of working fluid is leaked into the surrounding environment.

Although a simple thermodynamic cycle 100 is illustrated and discussed herein, those skilled in the art will recognize that other classes of thermodynamic cycles may equally be implemented into the present disclosure. For example, cascading and/or parallel thermodynamic cycles may be used, without departing from the scope of the disclosure. Various examples of cascading and parallel thermodynamic cycles that may apply to the present disclosure are described in co-pending PCT Pat. App. No. US2011/29486 entitled "Heat Engines with Cascade Cycles," and co-pending U.S. patent application Ser. No. 13/212,631 entitled "Parallel Cycle Heat Engines," the contents of which are each hereby incorporated by reference.

In one or more embodiments, the working fluid used in the thermodynamic cycle 100 is carbon dioxide ($CO_2$). It should be noted that use of the term $CO_2$ is not intended to be limited to $CO_2$ of any particular type, purity, or grade. For example, industrial grade $CO_2$ may be used without departing from the scope of the disclosure. In other embodiments, the working fluid may be a binary, ternary, or other working fluid blend. In other embodiments, the working fluid may be a combination of $CO_2$ and one or more other miscible fluids. In yet other embodiments, the working fluid may be a combination of $CO_2$ and propane, or $CO_2$ and ammonia, without departing from the scope of the disclosure.

Moreover, use of the term "working fluid" is not intended to limit the state or phase of the working fluid. For instance, the working fluid may be in a fluid phase, a gas phase, a supercritical state, a subcritical state or any other phase or state at any one or more points within the thermodynamic cycle 100. In one or more embodiments, the working fluid is in a supercritical state over certain portions of the thermodynamic cycle 100 (i.e., a high pressure side), and in a subcritical state at other portions of the thermodynamic cycle 100 (i.e., a low pressure side). In other embodiments, the entire thermodynamic cycle 100 may be operated such that the working fluid is maintained in either a supercritical or subcritical state throughout the entire working fluid circuit 102.

The thermodynamic cycle 100 may include a main pump 104 that pressurizes and circulates the working fluid throughout the working fluid circuit 102. The pump 104 can also be or include a compressor. The pump 104 drives the working fluid toward a heat exchanger 106 that is in thermal communication with a heat source $Q_{in}$. Through direct or indirect interaction with the heat source $Q_{in}$, the heat exchanger 106 increases the temperature of the working fluid flowing therethrough.

The heat source $Q_{in}$ derives thermal energy from a variety of high temperature sources. For example, the heat source $Q_{in}$ may be a waste heat stream such as, but not limited to, gas turbine exhaust, process stream exhaust, or other combustion product exhaust streams, such as furnace or boiler exhaust streams. The thermodynamic cycle 100 may be configured to transform this waste heat into electricity for applications ranging from bottom cycling in gas turbines, stationary diesel engine gensets, industrial waste heat recovery (e.g., in refineries and compression stations), and hybrid alternatives to the internal combustion engine. In other embodiments, the heat source $Q_{in}$ may derive thermal energy from renewable sources of thermal energy such as, but not limited to, solar thermal and geothermal sources.

While the heat source $Q_{in}$ may be a fluid stream of the high temperature source itself, in other embodiments the heat source $Q_{in}$ may be a thermal fluid that is in contact with the high temperature source. The thermal fluid may deliver the thermal energy to the waste heat exchanger 106 to transfer the energy to the working fluid in the circuit 100.

A power turbine 108 is arranged downstream from the heat exchanger 106 and receives and expands the heated working fluid discharged from the heat exchanger 106. The power turbine 108 may be any type of expansion device, such as an expander or a turbine, and may be operatively coupled to an alternator or generator 110, or some other load receiving device configured to receive shaft work. The generator 110 converts the mechanical work provided by the power turbine 108 into usable electrical power.

The power turbine 108 discharges the working fluid toward a recuperator 112 fluidly coupled downstream thereof. The recuperator 112 transfers residual thermal energy in the working fluid to the working fluid initially discharged from the pump 104. Consequently, the temperature of the working fluid discharged from the power turbine 108 is decreased in the recuperator 112 and the temperature of the working fluid discharged from the pump 104 is simultaneously increased.

The pump 104 may be powered by a motor 114 or similar driver device. In other embodiments, the pump 104 may be operatively coupled to the power turbine 108 or some other expansion device in order to drive the pump 104. Embodiments where the pump 104 is driven by the turbine 108 or another drive turbine (not shown) are described in co-pending U.S. patent application Ser. No. 13/205,082 entitled "Driven Starter Pump and Start Sequence," the contents of which are hereby incorporated by reference to the extent consistent with this disclosure.

A condenser 116 is fluidly coupled to the recuperator 112 and configured to condense the working fluid by further reducing its temperature before reintroducing the liquid or substantially-liquid working fluid to the pump 104. The cooling potential of the condenser 116 is directly dependent on the temperature of its cooling medium, which is usually ambient air or water circulated therein. Depending on the resulting temperature and pressure at the suction inlet of the pump 104, the working fluid may be either subcritical or supercritical at this point.

Figure 2:
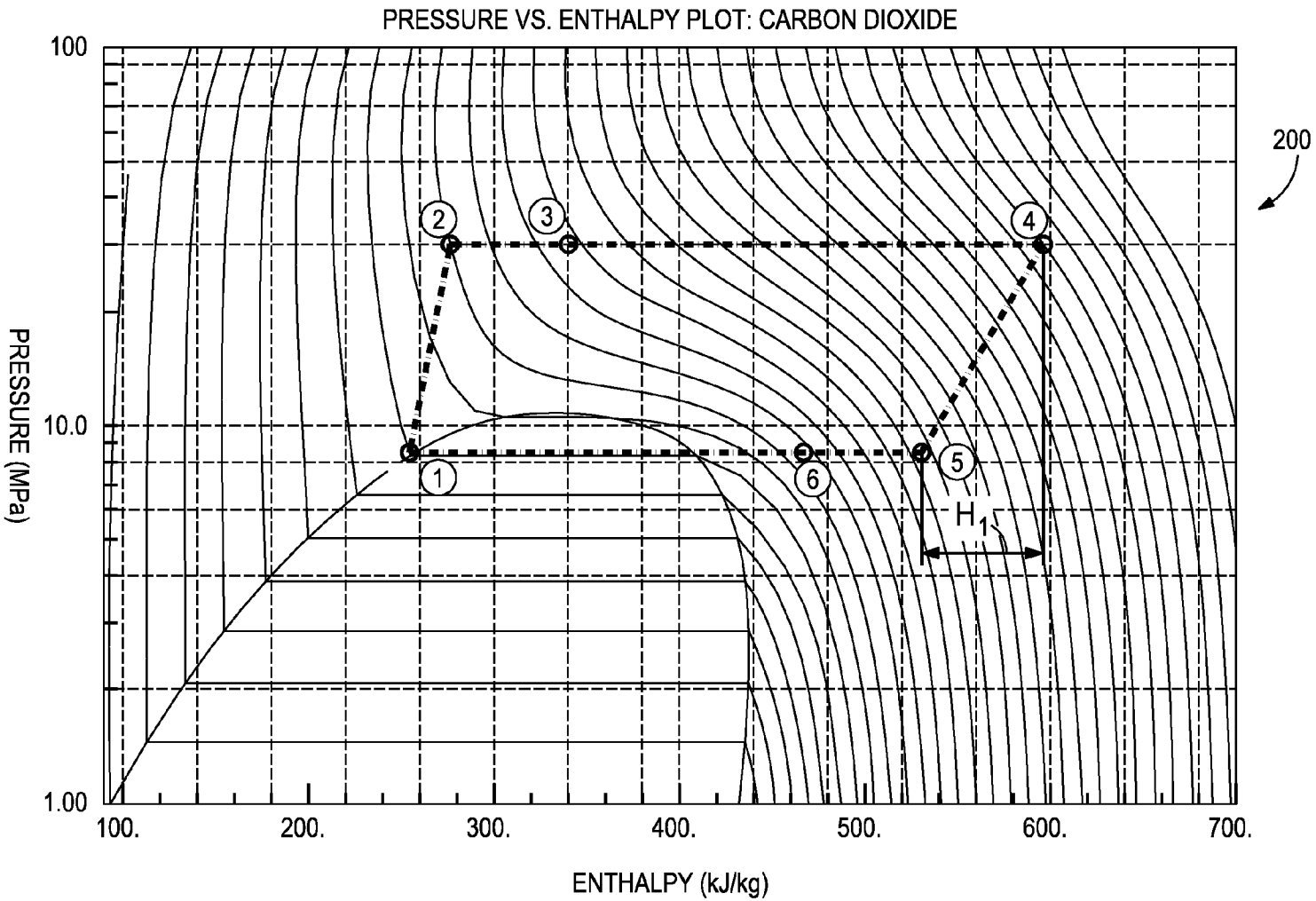
FIG. 2 illustrates a pressure-enthalpy diagram for a working fluid.

Referring to FIG. 2, with continued reference to FIG. 1, the thermodynamic cycle 100 may be described with reference to a pressure-enthalpy diagram 200 corresponding to the working fluid in the working fluid circuit 102. For example, the diagram 200 depicts the pressure-enthalpy plot for $CO_2$ circulating throughout the fluid circuit 102 on a standard temperature day (e.g., about 20° C.). The various points 1-6 indicated in FIG. 2 correspond to equivalent locations 1-6 depicted throughout the fluid circuit 102 in FIG. 1. Point 1 is indicative of the working fluid adjacent the suction inlet of the pump 104, as indicated in FIG. 1, and at this point the working fluid exhibits its lowest pressure and enthalpy compared to any other point in the cycle 100. At point 1, the working fluid may be in a liquid or substantially-liquid phase. As the working fluid is pumped or otherwise compressed to a higher pressure, its state moves from point 1 to point 2 on the diagram 200, or downstream from the pump 104, as indicated in FIG. 1.

Thermal energy is initially and internally introduced to the working fluid via the recuperator 112, which moves the working fluid from point 2 to point 3 at a constant pressure. Additional thermal energy is externally added to the working fluid via the heat exchanger 106, which moves the working fluid from point 3 to point 4. As thermal energy is introduced to the working fluid, both the temperature and enthalpy of the working fluid increase.

At point 4, the working fluid is at or adjacent the inlet to the power turbine 108. As the working fluid is expanded across the power turbine 108 to point 5, its temperature and enthalpy is reduced representing the work output derived from the expansion process. Thermal energy is subsequently removed from the working fluid in the recuperator 112, thereby moving the working fluid from point 5 to point 6. Point 6 is indicative of the working fluid being downstream from the recuperator 112 and/or near the inlet to the condenser 116. Additional thermal energy is removed from the working fluid in the condenser 116 and thereby moves from point 6 back to point 1 in a fluid or substantially-fluid state.

The work output for the cycle 100 is directly related to the pressure ratio achievable across the power turbine 108 and the amount of enthalpy loss realized as the working fluid is expanded from point 4 to point 5. As illustrated, a first enthalpy loss $H_1$ is realized as the working fluid is expanded from point 4 to point 5, and represents the work output for the cycle 100 using $CO_2$ as the working fluid on a standard temperature day.

As will be appreciated, each process (i.e., 1-2, 2-3, 3-4, 4-5, 5-6, and 6-1) need not occur exactly as shown on the exemplary diagram 200, and instead each step of the cycle 100 could be achieved in a variety of ways. For example, those skilled in the art will recognize that it is possible to achieve a variety of different coordinates on the diagram 200 without departing from the scope of the disclosure. Similarly, each point on the diagram 200 may vary dynamically over time as variables within, and external to, the cycle 100 change, such as ambient temperature, heat source $Q_{in}$ temperature, amount of working fluid in the system, combinations thereof, etc. In one embodiment, the working fluid may transition from a supercritical state to a subcritical state (i.e., a transcritical cycle) between points 4 and 5. In other embodiments, however, the pressures at points 4 and 5 may be selected or otherwise manipulated such that the working fluid remains in a supercritical state throughout the entire cycle 100.

The efficiency of the thermodynamic cycle 100 is dependent at least in part on the pressure ratio achieved across the power turbine 108; the higher the pressure ratio, the higher the efficiency of the cycle 100. This pressure ratio can be maximized by manipulating the temperature of the working fluid in the working fluid circuit 102, especially at the suction inlet of the pump 104 (i.e., point 1) which is primarily cooled using the condenser 116.

On hot days, however, the cooling potential of the condenser 116 is lessened since the cooling medium (e.g., ambient air or water) circulates at a higher temperature and is therefore unable to condense or otherwise cool the working fluid as efficiently as at cooler ambient temperatures. As used herein, "hot" refers to ambient temperatures that are close to (i.e., within 5° C.) or higher than the critical temperature of the working fluid. For example, the critical temperature for $CO_2$ is approximately 31° C., and on a hot day the cooling medium can be circulated in the condenser 116 at temperatures greater than 31° C.

Figure 3:
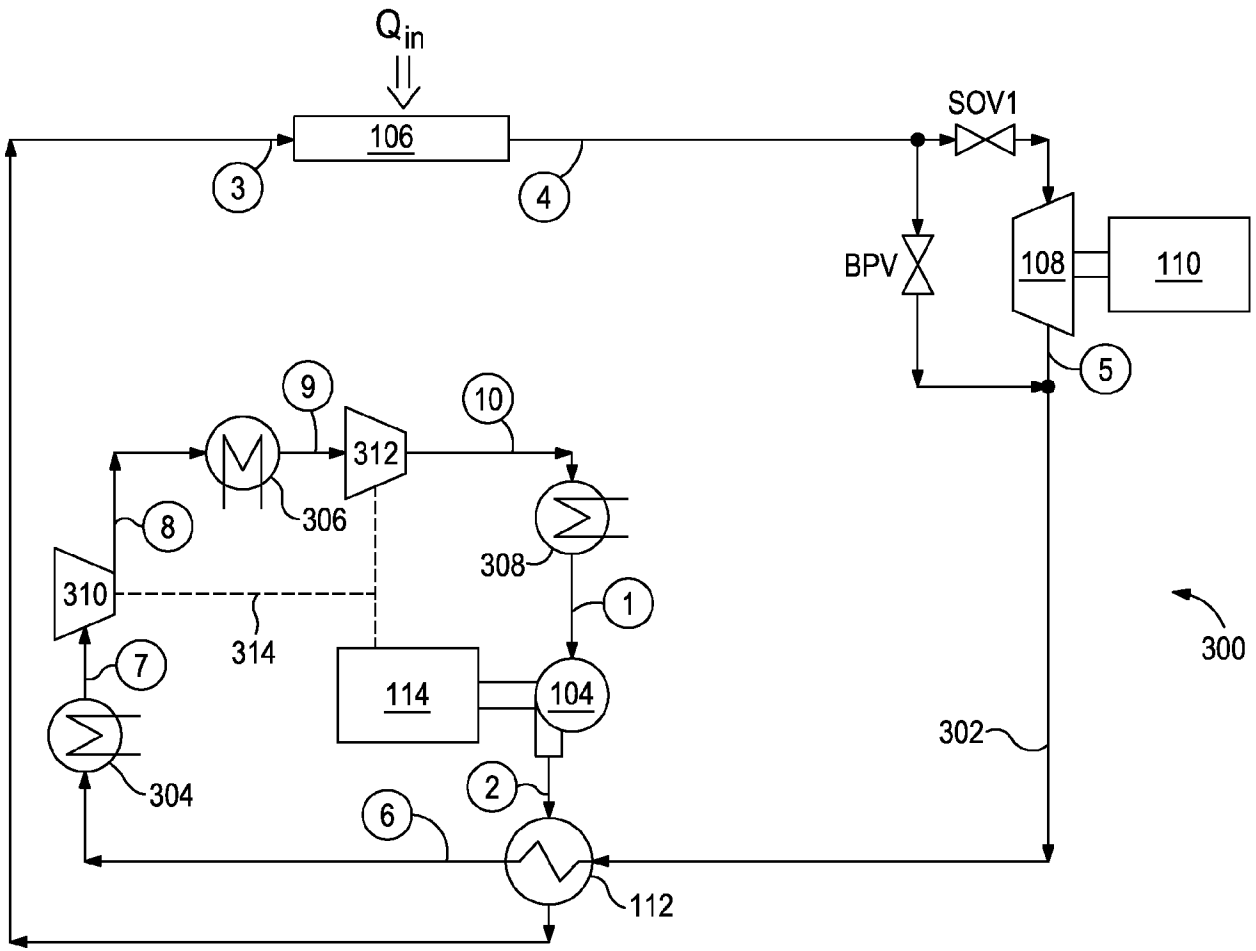
FIG. 3 illustrates another exemplary thermodynamic cycle, according to one or more embodiments of the disclosure.

In order to anticipate or otherwise mitigate the adverse effects of hot day temperatures, FIG. 3 illustrates another thermodynamic cycle 300, according to one or more embodiments. The cycle 300 may be substantially similar to the thermodynamic cycle 100 described above with reference to FIG. 1, and therefore may be best understood with reference thereto where like numerals indicate like components that will not be described again in detail. The cycle 300 includes a working fluid circuit 302 that fluidly couples the various components. Instead of using a condenser 116 to cool and condense the working fluid, however, the working fluid circuit 302 pumps or otherwise compresses the working fluid in multiple steps, implementing intercooling stages between each step.

Specifically, the working fluid circuit 302 includes a precooler 304, an intercooler 306, and a cooler (or condenser) 308, collectively, the intercooling components 304, 306, 308. The intercooling components 304, 306, 308 are configured to cool the working fluid stagewise instead of in one step. In other words, as the working fluid successively passes through each intercooling component 304, 306, 308, the temperature of the working fluid is progressively decreased.

The cooling medium used in each intercooling component 304, 306, 308 may be air or water at or near (i.e., +/−5° C.) ambient temperature. The cooling medium for each intercooling component 304, 306, 308 may originate from the same source, or the cooling medium may originate from different sources or at different temperatures in order to optimize the power output from the circuit 302. In embodiments where ambient water is the cooling medium, one or more of the intercooling components 304, 306, 308 may be printed circuit heat exchangers, shell and tube heat exchangers, plate and frame heat exchangers, brazed plate heat exchangers, combinations thereof, or the like. In embodiments where ambient air is the cooling medium, one or more of the intercooling components 304, 306, 308 may be direct air-to-working fluid heat exchangers, such as fin and tube heat exchangers or the like.

The working fluid circuit 302 also includes a first compressor 310 and a second compressor 312 in fluid communication with the intercooling components 304, 306, 308. The first compressor 310 interposes the precooler 304 and the intercooler 306, and the second compressor interposes the intercooler 306 and the cooler 308. The working fluid passing through each compressor 310, 312 may be in a substantially gaseous or supercritical phase.

The compressors 310, 312 may be independently driven using one or more external drivers (not shown), or may be operatively coupled to the motor 114 via a common shaft 314. In at least one embodiment, one or both of the compressors 310, 312 is directly driven by a drive turbine (not shown), or any of the turbines (expanders) in the fluid circuit 302. The compressors 310, 312 may be centrifugal compressors, axial compressors, or the like.

Although two compressors 310, 312 and three intercooling components 304, 306, 308 are illustrated and described herein, those skilled in the art will readily recognize that any number of compression stages with intercoolers can be implemented, without departing from the scope of the disclosure. For example, embodiments contemplated herein include having only the precooler 304 and intercooler 306 interposed by the first compressor 310, where the intercooler 306 is fluidly coupled to the pump 104 for recirculation. Other embodiments may include more than one compressor interposing fluidly adjacent intercooling components 304, 306 or 306, 308.

Figure 4:
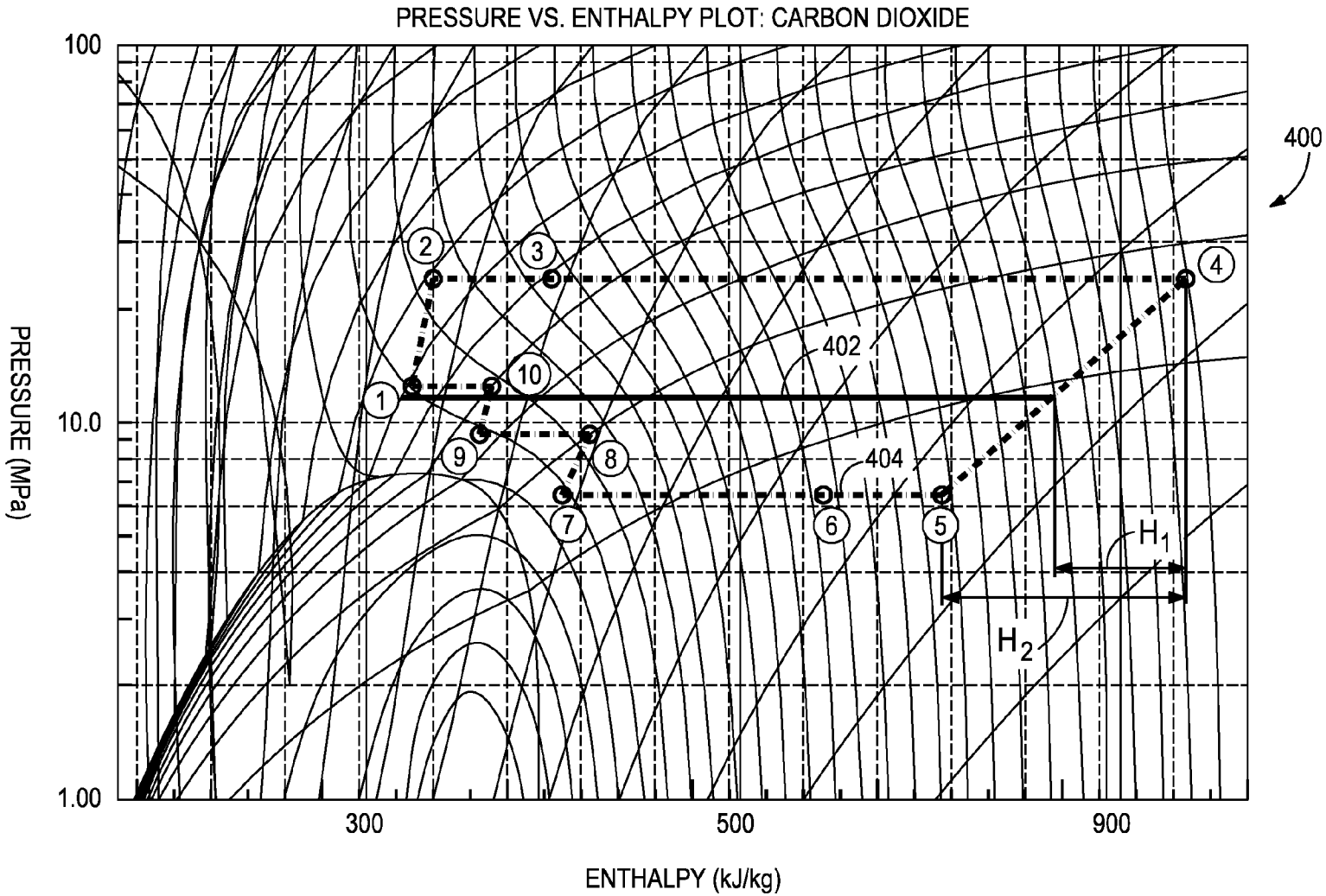
FIG. 4 illustrates another pressure-enthalpy diagram for a working fluid.

Referring to FIG. 4, with continued reference to FIG. 3, the thermodynamic cycle 300 may be described with reference to a pressure-enthalpy diagram 400 corresponding to $CO_2$ as the working fluid. The diagram 400 shows the pressure-enthalpy path that $CO_2$ will generally traverse in the fluid circuit 302 on a hot day (e.g., about 45° C.). Moreover, the diagram 400 compares a first loop 402 and a second loop 404, where both loops 402, 404 circulate $CO_2$ as the working fluid and are illustrated together in order to emphasize the various differences. The first loop 402 is generally indicative of the thermodynamic cycle 100 of FIG. 1, where the condenser 116 uses a cooling medium at about 45° C. to cool the working fluid before it is reintroduced into the pump 104. The second loop 404 is indicative of the thermodynamic cycle 300 of FIG. 3, where the working fluid is compressed and cooled stagewise with the compressors 310, 312 interposing the intercooling components 304, 306, 308 using a cooling medium at about 45° C.

The various points depicted in the diagram 400 (1-10) generally correspond to the similarly-numbered locations in the working fluid circuit 302 as indicated in FIG. 3. Points 1-6 are substantially similar to points 1-6 shown in FIG. 2 and described therewith, and therefore will not be described again in detail. Point 6 is indicative of the working fluid downstream from the recuperator 112 and/or near the inlet to the precooler 304. Thermal energy is removed from the working fluid in the precooler 304, thereby decreasing the enthalpy of the working fluid at a substantially constant pressure and moving the working fluid from point 6 to point 7. Point 7 is indicative of at or adjacent the inlet to the first compressor 310. The first compressor 310 increases the pressure of the working fluid and slightly increases its temperature and enthalpy, as it moves from point 7 to point 8.

Additional thermal energy is then removed from the working fluid in the intercooler 306, thereby decreasing the enthalpy of the working fluid again at a substantially constant pressure and moving the working fluid from point 8 to point 9. Point 9 is indicative of at or adjacent the inlet to the second compressor 312, which increases the pressure and temperature of the working fluid as it moves from point 9 to point 10. Additional thermal energy is removed from the working fluid in the cooler (condenser) 308, thereby further decreasing the enthalpy of the working fluid at a substantially constant pressure and moving the working fluid from point 10 back to point 1 in a fluid or substantially-fluid state.

As can be seen in the diagram 400, point 1 in the second loop 404 is substantially adjacent corresponding point 1 for the first loop 402. Accordingly, the process undertaken in the second loop 404, which represents the gas-phase compression with intercooling stages, results in substantially the same start point as the process undertaken in the first loop 402, which represents using the condenser 116 described with reference to FIG. 1. One of the significant differences between the two loops 402, 404, however, is the resulting work output of each loop 402, 404. The work output is directly related to the pressure ratio of each loop 402, 404 and represented in the diagram 400 by the amount of enthalpy loss realized in each cycle 100, 300, respectively, as the working fluid is expanded across the power turbine 108 from point 4 to point 5.

For instance, the first loop 402 realizes a first enthalpy loss $H_1$ as the working fluid is expanded, and the second loop 404 realizes a second, larger enthalpy loss $H_2$ as the working fluid is expanded across a greater differential. Although the second loop 404 requires more compression steps than the first loop 402 (which only requires one compression step at the pump 104) to return to point 1, the compression ratio of the second loop 404, as measured from point 4 to point 5, is much larger than the compression ratio of the first loop 402. Consequently, the work output of the second loop 404 is much larger than the work output of the first loop 402, and makes up for the multiple compression stages and otherwise surpasses the net work output of the first loop 402 on hot days. In other words, while increasing the pressure ratio between points 4 and 5 requires additional compression work, it simultaneously supplies a greater work output than what would otherwise be achievable using the single compression method represented by the first loop 402.

Figure 5:
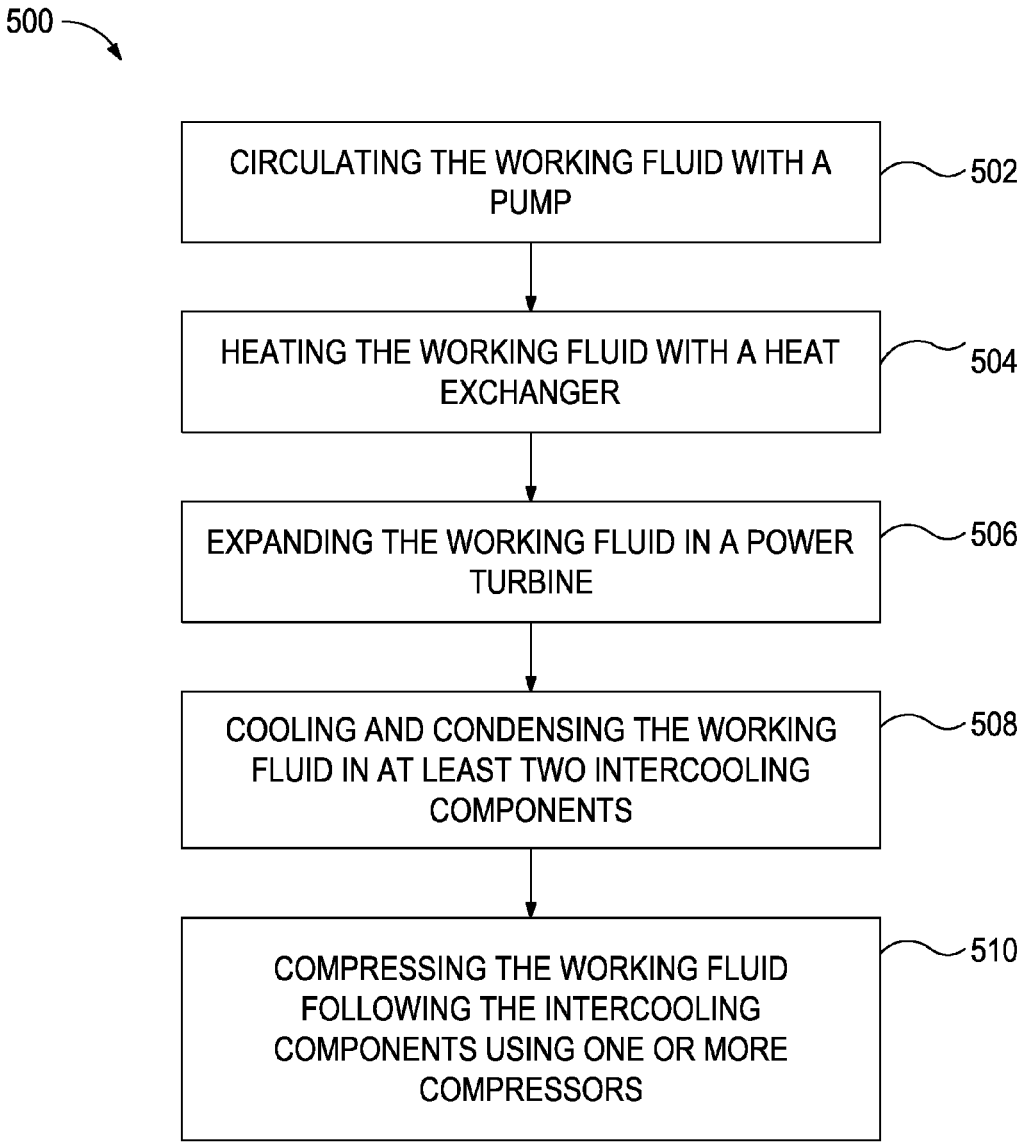
FIG. 5 illustrates a flowchart of a method for regulating the pressure and temperature of a working fluid in a working fluid circuit, according to one or more embodiments of the disclosure.

Referring now to FIG. 5, illustrated is a method 500 for regulating the pressure and temperature of a working fluid in a working fluid circuit. The method 500 may include circulating the working fluid through the working fluid circuit with a pump, as at 502. The working fluid may then be heated in a heat exchanger, as at 504. The heat exchanger is arranged in the working fluid circuit and in fluid communication with the pump. The heat exchanger is also in thermal communication with a heat source in order to heat the working fluid. After being discharged from the heat exchanger, the working fluid may be expanded in a power turbine, as at 506. The power turbine may be fluidly coupled to the heat exchanger.

The method 500 may also include cooling and condensing the working fluid discharged from the power turbine in at least two intercooling components, as at 508. The intercooling components may be in fluid communication with the power turbine and cool the working fluid using a cooling medium at ambient temperature. In one embodiment, the ambient temperature is above the critical temperature of the working fluid. The working fluid is compressed following the intercooling components using one or more compressors, as at 510. At least one of the one or more compressors is interposed between fluidly adjacent intercooling components.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A working fluid circuit for converting thermal energy into mechanical energy, comprising:

a pump configured to circulate a working fluid through the working fluid circuit having a low pressure side and a high pressure side;

a heat exchanger in fluid communication with the pump and in thermal communication with a heat source, the heat exchanger being configured to transfer thermal energy from the heat source to the working fluid;

a power turbine fluidly coupled to the heat exchanger and configured to expand the working fluid discharged from the heat exchanger to generate the mechanical energy;

two or more intercooling components disposed downstream of the power turbine and upstream of the pump on the low pressure side of the working fluid circuit, in fluid communication with the power turbine, and configured to cool and condense the working fluid using a cooling medium derived at or near ambient temperature; and one or more compressors disposed downstream of the power turbine and upstream of the pump on the low pressure side of the working fluid circuit and fluidly coupled to the two or more intercooling components such that at least one of the one or more compressors is interposed between adjacent intercooling components.

2. The working fluid circuit of claim 1, wherein the working fluid is carbon dioxide.

3. The working fluid circuit of claim 2, wherein the carbon dioxide is supercritical over at least a portion of the working fluid circuit.

4. The working fluid circuit of claim 1, further comprising a generator coupled to the power turbine to convert the mechanical energy into electricity.

5. The working fluid circuit of claim 1, wherein the cooling medium is air or water.

6. The working fluid circuit of claim 1, wherein the ambient temperature is within about 5° C. of a critical temperature of the working fluid or above the critical temperature of the working fluid.

7. The working fluid circuit of claim 1, further comprising a recuperator fluidly coupled to the power turbine and in fluid communication with the two or more intercooling components, the recuperator being configured to transfer thermal energy from the working fluid discharged from the power turbine to the working fluid discharged from the pump.

8. The working fluid circuit of claim 1, wherein the two or more intercooling components include a precooler, an intercooler, and a condenser.

9. The working fluid circuit of claim 8, wherein the one or more compressors include a first compressor and a second compressor, the first compressor interposing the precooler and the intercooler, and the second compressor interposing the intercooler and the condenser.

10. The working fluid circuit of claim 1, wherein the one or more compressors are operatively coupled together and driven by a common motor.

11. A method for regulating a pressure and a temperature of a working fluid in a working fluid circuit, comprising:

circulating the working fluid through the working fluid circuit having a low pressure side and a high pressure side with a pump;

heating the working fluid in a heat exchanger arranged in the working fluid circuit in fluid communication with the pump, the heat exchanger being in thermal communication with a heat source;

expanding the working fluid discharged from the heat exchanger in a power turbine fluidly coupled to the heat exchanger;

cooling and condensing the working fluid discharged from the power turbine in at least two intercooling components in fluid communication with the power turbine and disposed downstream of the power turbine and upstream of the pump along the direction of flow of the working fluid through the working fluid circuit, the at least two intercooling components using a cooling medium at an ambient temperature to cool the working fluid, wherein the ambient temperature is above a critical temperature of the working fluid; and compressing the working fluid discharged from the two or more intercooling components with one or more compressors disposed downstream of the power turbine and upstream of the pump along the direction of flow of the working fluid through the working fluid circuit, and fluidly coupled to the two or more intercooling components such that at least one of the one or more compressors is interposed between fluidly adjacent intercooling components.

12. The method of claim 11, further comprising transferring thermal energy from the working fluid discharged from the power turbine to the working fluid discharged from the pump using a recuperator fluidly coupled to the power turbine and the two or more intercooling components.

13. The method of claim 11, further comprising driving the one or more compressors with a common motor having a common shaft operatively coupled to the one or more compressors.

14. The method of claim 11, wherein expanding the working fluid discharged from the heat exchanger in the power turbine further comprises extracting mechanical work from the power turbine.

15. A working fluid circuit, comprising:

a pump configured to circulate a carbon dioxide working fluid through the working fluid circuit having a low pressure side and a high pressure side;

a waste heat exchanger in fluid communication with the pump and in thermal communication with a waste heat source, the heat exchanger being configured to transfer thermal energy from the waste heat source to the carbon dioxide working fluid;

a power turbine fluidly coupled to the heat exchanger and configured to expand the carbon dioxide working fluid discharged from the heat exchanger;

a precooler disposed downstream of the power turbine and upstream of the pump on the low pressure side of the working fluid circuit, fluidly coupled to the power turbine, and configured to remove thermal energy from the carbon dioxide working fluid;

a first compressor disposed downstream of the power turbine and upstream of the pump on the low pressure side of the working fluid circuit, fluidly coupled to the precooler, and configured to increase a pressure of the carbon dioxide working fluid; and an intercooler disposed downstream of the power turbine and upstream of the pump on the low pressure side of the working fluid circuit, fluidly coupled to the first compressor, and configured to remove additional thermal energy from the carbon dioxide working fluid, the first compressor fluidly interposing the precooler and the intercooler.

16. The working fluid circuit of claim 15, further comprising:

a second compressor disposed downstream of the power turbine and upstream of the pump on the low pressure side of the working fluid circuit, fluidly coupled to the intercooler, and configured to further increase the pressure of the carbon dioxide working fluid; and a cooler disposed downstream of the power turbine and upstream of the pump on the low pressure side of the working fluid circuit, fluidly coupled to the second compressor, and configured to remove additional thermal energy from the carbon dioxide working fluid, the cooler discharging the carbon dioxide working fluid in a substantially fluid state.

17. The working fluid circuit of claim 16, wherein the first and second compressors are operatively coupled together via a common shaft and driven by a common motor.

18. The working fluid circuit of claim 15, wherein the carbon dioxide working fluid is supercritical over at least a portion of the working fluid circuit.

19. The working fluid circuit of claim 15, further comprising a recuperator in fluid communication with the power turbine and the precooler, the recuperator being configured to transfer thermal energy from the carbon dioxide working fluid discharged from the power turbine to the carbon dioxide working fluid discharged from the pump.

20. The working fluid circuit of claim 15, wherein the cooling medium is ambient air or ambient water.

* * * * *